US005971527A

United States Patent [19]

Peeters et al.

[11] Patent Number: 5,971,527

[45] Date of Patent: Oct. 26, 1999

[54] INK JET CHANNEL WAFER FOR A THERMAL INK JET PRINTHEAD

[75] Inventors: Eric Peeters, Rochester; James F. O'Neill, Penfield; Joel Alan Kubby; R. Enrique Viturro, both of Rochester; Constance J. Thornton, Ontario; David Allen Mantell, Rochester, all of N.Y.

[73] Assignee: Xerox Corporation, Stamford, Conn.

[21] Appl. No.: 08/741,422

[22] Filed: Oct. 29, 1996

[51] Int. Cl.[6] ..... B41J 2/05; B41J 2/19

[52] U.S. Cl. ..... 347/65; 347/92; 216/27; 216/99

[58] Field of Search ..... 347/63, 56, 54, 347/20, 1, 67, 65; 216/27, 99; 438/733

[56] References Cited

U.S. PATENT DOCUMENTS

| | | | |
|---|---|---|---|
| Re. 32,572 | 1/1988 | Hawkins et al. | 156/626 |
| 4,169,008 | 9/1979 | Kurth | 156/600 |
| 4,169,821 | 10/1979 | Werner et al. | 260/27 BB |
| 4,600,934 | 7/1986 | Aine et al. | 357/26 |
| 4,638,337 | 1/1987 | Torpey et al. | 346/140 R |
| 4,678,529 | 7/1987 | Drake et al. | 156/234 |
| 4,774,530 | 9/1988 | Hawkins | 346/140 R |
| 4,786,357 | 11/1988 | Campanelli et al. | 156/633 |
| 4,789,425 | 12/1988 | Drake et al. | 156/644 |
| 4,863,560 | 9/1989 | Hawkins | 156/644 |
| 4,875,968 | 10/1989 | O'Neill et al. | 156/633 |
| 4,882,595 | 11/1989 | Trueba et al. | 346/140 R |
| 4,915,718 | 4/1990 | Desai | 65/31 |
| 4,961,821 | 10/1990 | Drake et al. | 156/647 |
| 5,096,535 | 3/1992 | Hawkins et al. | 156/633 |
| 5,160,577 | 11/1992 | Deshpande | 156/644 |
| 5,196,378 | 3/1993 | Bean et al. | 437/226 |
| 5,277,755 | 1/1994 | O'Neill | 156/647 |
| 5,308,442 | 5/1994 | Taub et al. | 156/644 |
| 5,368,683 | 11/1994 | Altavela et al. | 156/133 |
| 5,385,635 | 1/1995 | O'Neill | 156/647 |
| 5,412,412 | 5/1995 | Drake et al. | 347/40 |
| 5,450,108 | 9/1995 | Drake et al. | 347/65 |
| 5,460,687 | 10/1995 | Douglas . | |
| 5,484,073 | 1/1996 | Erickson | 216/2 |

FOREIGN PATENT DOCUMENTS

| | | | |
|---|---|---|---|
| 405131627 | 5/1993 | Japan | 347/65 |

OTHER PUBLICATIONS

Prof. W. Dutre et al., *Process Development For 3D Silicon Microstructures, With Application To Mechanical Sensor Devices*, Chapter 2, pp. 13–70, Katholieke Universiteit Leuven, Mar. 1994.

*Primary Examiner*—Benjamin R. Fuller
*Assistant Examiner*—Juanita Stephens
*Attorney, Agent, or Firm*—Oliff & Berridge, PLC

[57] ABSTRACT

An ink jet channel wafer for an ink jet printer has a first surface in which a plurality of anisotropically etched ink channels and an anisotropically etched ink reservoir are directly connected to one another. The ink jet channel wafer is etched using an admixture of at least one alkali metal hydroxide and at least one alcohol compound.

12 Claims, 8 Drawing Sheets

L/D = 1.32
(D = ETCH DEPTH)

L/D = 0.4
(D = ETCH DEPTH)

KOH

170 µm ETCH DEPTH

INK JET CHANNEL WAFER FOR A THERMAL INK JET PRINTHEAD

BACKGROUND OF THE INVENTION

1. Field of the Invention

The present invention is directed to a thermal ink jet printhead. More specifically, the present invention is directed to a thermal ink jet printhead fabrication process utilizing orientation dependent etching (ODE).

2. Background

Thermal ink jet printing is a type of drop-on-demand ink jet systems, wherein an ink jet printhead expels ink droplets on demand by the selective application of electrical pulses to thermal energy generators, usually resistors, located one each in capillary-filled, parallel ink channels a predetermined distance upstream from the channel nozzles or orifices. The channel end opposite the nozzles are in communication with a small ink reservoir to which a larger external ink supply is connected.

U.S. Pat. Reissue No. 32,572 to Hawkins et al. discloses a thermal ink jet printhead and several fabrication processes therefor. Each printhead is composed of two parts aligned and bonded together. One part is a substantially flat substrate that contains on the surface thereof a linear array of heating elements and addressing electrodes, and the second part is a silicon substrate having at least one recess anisotropically etched therein to serve as an ink supply reservoir when the two parts are bonded together. A linear array of parallel grooves are also formed in the second part, so that one end of the grooves communicate with the reservoir recess and the other end of the grooves are open for use as ink droplet expelling nozzles. Many printheads can be made simultaneously by producing a plurality of sets of heating element arrays with their addressing electrodes on a silicon wafer and by placing alignment marks thereon at predetermined locations. A corresponding plurality of sets of channel grooves and associated reservoir are produced in a second silicon wafer. In one embodiment, alignment openings are etched in the second silicon wafer at predetermined locations. The two wafers are aligned via the alignment openings and alignment marks, then bonded together and diced into many separate printheads.

U.S. Pat. No. 4,638,337 to Torpey et al. discloses an improved thermal ink jet printhead similar to that of Hawkins et al., but has each of its heating elements located in a recess. The recess walls containing the heating elements prevent the lateral movement of the bubbles through the nozzle and therefore the sudden release of vaporized ink to the atmosphere, known as blow-out, which causes ingestion of air and interrupts the printhead operation when this event occurs. In this patent a thick film organic structure such as Riston® or Vacrel® is interposed between the heater plate and the channel plate. The purpose of this layer is to have recesses formed therein directly above the heating elements to contain the bubble, thus eliminating the occurrence of vapor blow-out and concomitant air ingestion.

U.S. Pat. No. 4,774,530 to Hawkins discloses the use of a patterned thick film insulative layer to provide the flow path between the ink channels and the reservoir, thereby eliminating the fabrication steps required to open the channel groove closed ends to the reservoir recess, so that the printhead fabrication process is simplified.

U.S. Pat. No. 4,786,357 to Campanelli et al. discloses the use of a patterned thick film insulative layer between mated and bonded substrates. One substrate has a plurality of heating element arrays and addressing electrodes formed on the surface thereof and the other being a silicon wafer having a plurality of etched reservoirs, with each reservoir having a set of ink channels. The patterned thick film layer provides a clearance space above each set of bonding pads of the addressing electrodes to enable the removal of the unwanted silicon material of the wafer by dicing without the need for etched recesses therein. The individual printheads are produced subsequently by dicing the assembled substrates.

As disclosed in the above-discussed patents, thermal ink jet printheads are fabricated from two substrates. One substrate contains the heating element and the other contains ink reservoirs/channels. When these two substrates are aligned and bonded together, the reservoirs/channels serve as ink passageways. A plurality of printhead components are formed on separate substrates, so that the substrate pairs may be aligned, mated, and diced into many individual printheads. The substrate for the plurality of sets of reservoir/channels is silicon and the features are formed by an anisotropic etching process. The anisotropic or orientation dependent etching (ODE) has been shown to be a high yielding fabrication process for precise, miniature channel plates. Such printheads are usually about ¼" to 1" wide and print small swaths of information while being translated across a stationary recording medium such as paper. The paper is then stepped the distance of one swath and the printing process continued until the entire page of paper is printed. This is a low speed process.

U.S. Pat. No. 4,774,530 to Hawkins discloses a two-part ink jet printhead comprising a mated channel plate and a heater plate, which sandwiches a thick film insulative layer that was previously deposited on the heater plate and patterned to provide an ink bypass recess for ink flow from the reservoir to the channels and recesses or pits over each heating element for placement of the heating elements in pits to prevent the vapor bubbles from blowing out the nozzles and causing ingestion of air. This is a typical ink jet printhead configuration and is discussed later with respect to FIG. 2.

U.S. Pat. No. 4,863,560 to Hawkins discloses a three dimensional silicon structure, such as an ink jet printhead, fabricated from (100) silicon wafers by a single side, multiple step ODE etching process. All etching masks are formed sequentially prior to the initiation of etching, with the coarsest mask formed last and etched first. Once the coarse anisotropic etching is completed, the coarse etch mask is removed and the anisotropic etching is resumed on the finer features.

U.S. Pat. No. 5,096,535 to Hawkins et al. discloses the fabrication of a printhead, wherein each of the ink channels is formed by segmenting the channel mask into a series of closely adjacent vias, such that during the subsequent anisotropic etching of the silicon wafer, the thin walls between the segments are eroded away before the completion of the etching step to produce continuous channels from the connected segments. Thus, mask alignment errors that would cause the channels to be greatly widened when the channels are one long recess are greatly reduced.

U.S. Pat. No. 5,196,378 to Bean et al. describes a method for separating semi-conductor dice formed in a semiconductor wafer by scribing and etching the wafer. An orientation dependent etch (ODE) or an anisotropic etch is utilized to separate the dice. The orientation dependent etch may be conducted utilizing a KOH-propanol etchant. Other anisotropic etchants include, but are not exclusive of, Tetramethyl Ammonium Hydroxide (TMAH) ethylenediamine pyrocatechol (EDP) and hydroxides of cesium and potassium as set forth in U.S. Pat. No. 4,600,934 to Anie et al.

The thermal ink jet printheads mentioned above require the formation of heater pits and bypass pits in a thick film insulative layer deposited on the heating element wafer. The bypass pits are formed in the thick film insulative layer to allow ink to pass from the reservoir to the individual channels.

The geometrical parameters and/or configurations of the ink flow paths in ink jet printheads are factors that determine the frequency of the droplet ejection and thus the printing speed. Orientation dependent etching restricts etched shapes to rectangles where fine dimensional control is required. With typical ODE etchants, convex corners are etched in a less controllable fashion. Some of the important geometrical parameters are the size of the nozzles relative to the cross-sectional area of the channels, and the size of the ink flow area at the bypass pit relative to the nozzles, for these dimensions influence capillary refill times from the ink supply in printhead reservoir. The cross-sectional area of the nozzle greatly influences latency. As fluid evaporates from the nozzle end the viscosity increases, eventually plugging the channel. Latency refers to the length of time before this plugging occurs.

Because the channels are isolated from the reservoir, the ink jet printheads require a thick insulative film with bypass pits formed therein to allow ink communication from the reservoir to the channels. Therefore, there is a need for more flexibility in the design and fabrication of silicon channel structures in ink jet printheads.

The presence of bypass and heater pits also generally results in an increase in a problem known as "dropout" caused by trapped air bubbles in the ink channels. These air bubbles get trapped in these pits, thus blocking ink flow.

Therefore, there is a need in the art for an ink jet printhead that limits the occurrence of dropout problems.

Moreover, thick insulative films formed on the heater element wafer severely limit the ink design latitude (e.g., pH, hydrolysis, viscosity, etc.). It also complicates front face wetting problems by introducing a second material (i.e., the insulation film material) on the front face of the printhead. Thus, there is a need for an ink jet printhead that allows for more flexibility in ink design latitude while limiting front face wetting problems.

SUMMARY OF THE INVENTION

The present invention relates to an ink jet channel wafer for an ink jet printer having a surface in which a plurality of anisotropically etched ink channels and an anisotropically etched ink reservoir are directly connected to one another. The ink jet channel wafer may also include a heater pit anisotropically etched in the surface of the ink jet channel wafer.

The present invention also relates to an ink jet printhead for an ink jet printer having an upper ink jet channel wafer with a plurality of anisotropically etched ink channels on a surface of an ink jet channel wafer that are directly connected to an anisotropically etched ink reservoir on the surface of the upper ink jet channel wafer. In addition, the present invention allows for the fabrication of features with convex corners. The ink jet printhead also includes a lower heater wafer comprising heater element electronics. In between the upper ink jet channel wafer and the lower heater wafer is a passivating film that protects the heater element electronics.

The present invention also relates to a process of making an ink jet channel wafer for an ink jet printer by forming a series of masks on a surface of the ink jet channel wafer and sequentially anisotropically etching the surface of the ink jet channel wafer to form a plurality of ink jet channels directly connected to an ink manifold recess. The crucial or fine etching step is conducted with an aqueous etchant including a mixture of water, at least one alkali metal hydroxide and at least one alcohol compound.

The present invention is also directed to a method of making an ink jet channel wafer for an ink jet printer by forming a mask on a surface of the ink jet channel wafer and anisotropically etching the surface of the ink jet channel wafer with an aqueous mixture of at least one alkali metal hydroxide and at least one alcohol compound to form multiple ink channels and ink reservoirs.

DETAILED DESCRIPTION OF EMBODIMENTS

Figure 1:
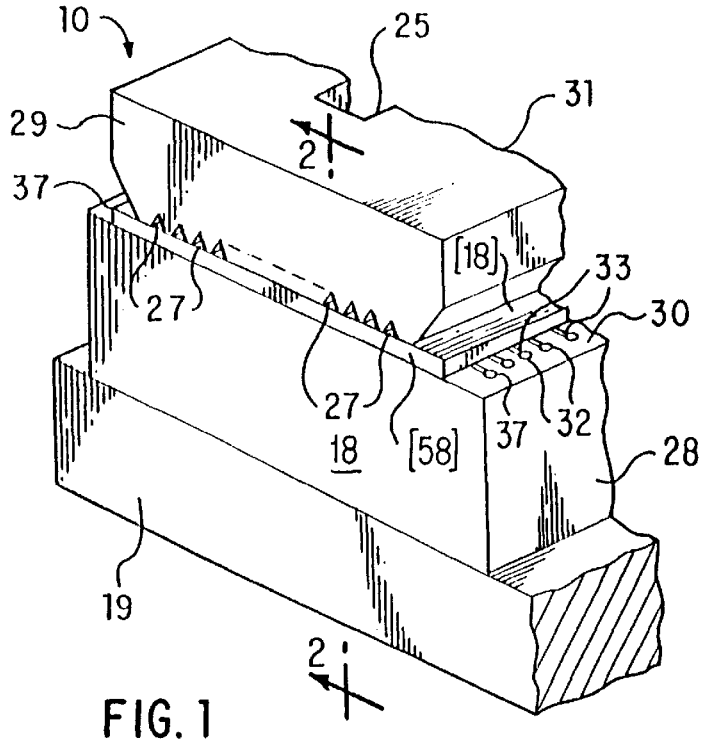
FIG. 1 is an enlarged cross-sectional view of a typical ink jet printhead.
Figure 2:
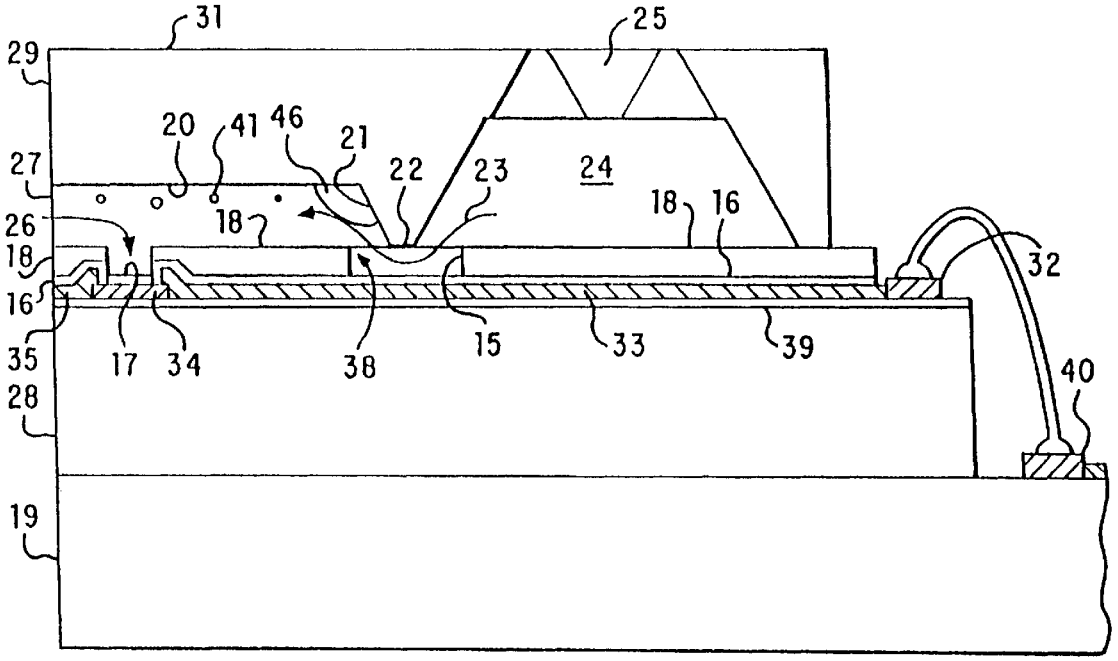
FIG. 2 PRIOR ART
FIG. 2 is an enlarged cross-sectional view of a typical ink jet printhead of FIG. 1, as viewed along the line "2—2" thereof.
Figure 3A:
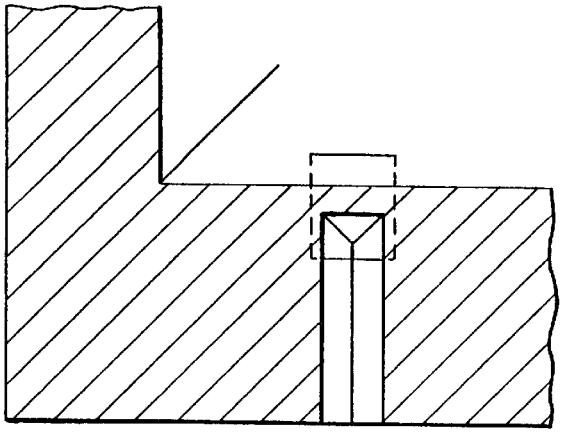
FIG. 3a PRIOR ART
FIG. 3*a* is an enlarged bottom view of the channel wafer of FIG. 3*b*, illustrating an unetched portion at one end of an ink channel, which requires the formation of a by-pass pit.
Figure 3B:
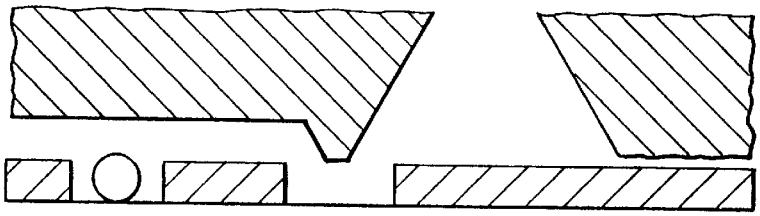
FIG. 3b PRIOR ART
Figure 4:
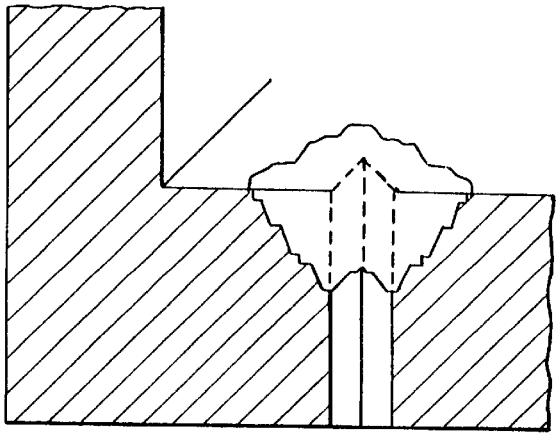
FIG. 4 PRIOR ART
FIG. 4 is an enlarged bottom view of a portion of an ink jet channel wafer representing the uncontrollable orientation dependent etching (ODE) of the prior art when attempting to directly connect the ink channel to an ink reservoir.

An enlarged, schematic isometric view of the front face 29 of a conventional printhead 10 showing the array of droplet emitting nozzles 27 is depicted in FIG. 1. Referring to FIG. 2, FIG. 1 viewed along line 2—2, the lower electrically insulated substrate or heating element plate 28 has the heating elements 34 and addressing electrodes 33 patterned on surface 30 thereof, while the upper substrate of channel plate 31 has parallel channels 20 that extend in one direction and penetrate through the upper substrate from the edge of front face 29. The other end of channels 20 terminate at slanted wall 21. The ink reservoir for the capillary filled ink channels 20, has an opening 25 therethrough for use as an ink inlet. The surface of the channel plate with the channels 20 are aligned and bonded to the heating element plate 28, so that a respective one of the plurality of heating elements 34 is positioned in each channel 20 and the lower electrically insulated substrate or heating element plate 28. Ink enters the reservoir 24 formed by the recess and the lower electrically insulated substrate 28 through the ink inlet 25 and, by capillary action, fills the channels 20 by flowing through a bypass pit 38 formed in the thick film insulative layer 18. The ink at each nozzle 27 forms a meniscus, the surface tension of which prevents the ink from weeping therefrom. The addressing electrodes 33 on the lower electrically insulated substrate or heating element plate 28 terminate at addressing electrode terminals 32. The upper substrate or channel plate 31 is smaller than that of the lower electrically insulated substrate or heating element plate 28 in order that the addressing electrode terminals 32 and bonding pads 37 are exposed and available for wire bonding to the electrodes on the daughter board 19, on which the printhead 10 is permanently mounted. Layer 18 is a thick film passivation layer sandwiched between upper and lower substrates. This layer is patterned to remove it from its protective layer 17 and to expose the heating elements, thus placing them in a pit 26, and is also patterned to form the bypass pit 38 to enable ink flow between the reservoir 24 and the ink channels 20. In addition, the thick film insulative layer 18 is patterned to expose the addressing electrode terminals 32.

A cross sectional view of FIG. 1 is taken along view line 2—2 through one channel and shown as FIG. 2 to show how the ink flows from the reservoir 24 under the channel end 22 and around the slanted wall 21 of the channel 20 as depicted by arrow 23 of a typical ink jet printhead. As is disclosed in U.S. Pat. No. 4,638,337 to Torpey et al., a plurality of sets of bubble generating heating elements 34 and their addressing electrodes 33 are patterned on the polished surface of a double side polished (100) silicon wafer. Prior to patterning, the multiple sets of addressing electrodes 33, the resistive materials that serve as the heating elements, and the common return 35, the polished surface of the wafer is coated with an underglaze layer 39 such as silicon dioxide, having a thickness of about 2 micrometers. The resistive material may be a doped polycrystalline silicon which may be deposited by chemical vapor deposition (CVD) or any other well known resistive material such as zirconium diboride ($ZrB_2$). The common return and the addressing electrodes are typically aluminum leads deposited on the underglaze and over the edges of the heating elements 34. The common return ends on bonding pads 37, FIG. 1, and addressing electrode terminals 32 are positioned at predetermined locations to allow clearance for wire bonding to the electrodes 40 of the daughter board 19, after the channel plate 31 is attached to make a printhead. The common return 35 and the addressing electrodes 33 are deposited to a thickness of 0.5 to 3 micrometers, with the preferred thickness being 0.75 to 1.0 micrometers.

Next, a thick film type insulative layer 18 such as, for example, Riston®, Vacrel®, Probimer 52®, or polyimide, is formed on the passivation layer 16 to a thickness of between 10 and 100 micrometers and preferably in the range of 25 to 50 micrometers. The thick film insulative layer 18 is photolithographically processed to enable removal of those portions of the thick film insulative layer 18 over each heating element and its protective layer 17 (forming pits 26), the bypass pit 38 for providing ink passage from the reservoir 24 to ink channels 20. The insulative material over each addressing electrode terminal 32 and bonding pad 37 and walls 15 defining an elongated recess to open the ink channels to the manifold is also removed.

During the printing process, small air bubbles 41 are ingested by the ink jet printhead through each nozzle 27. The slanted wall 21 at the end of channels 20 traps the bubbles 41 and allows them to accumulate to form a very large bubble 42 or pocket of air. When the bubble 42 grows to a significant size, it deleteriously affects the performance of the ink jet printhead. For example, the bubble 42 may constrict the size of the channel 20 and impede the flow of ink through the channel 20. This results in "drop out" problems, which, among other things, prevent sufficient ink from reaching the substrate or results in irregular ink formation on the substrate.

An embodiment of the present invention comprises a channel wafer that eliminates the need for a "bypass pit", i.e., a structure is formed by ODE whereby the ink channels are directly connected to the ink reservoir on the channel wafer. This allows for increasing the refill speed and print frequency as well as for overcoming dropout problems.

Reproducible fabrication of the structure is made possible by a dramatic improvement of the convex corner behavior of aqueous alkali metal hydroxide etching, which is achieved by the introduction of an alcohol compound as an etch additive. The improved convex corner behavior also permits reproducible ODE of the "heater pit" in the channel wafer, rather than in the thick heater wafer polyimide passivation layer. In this case, the only remaining function of the polyimide passivation layer is passivation/protection of the heater wafer electronics, which can be achieved with layers that are an order of magnitude thinner than the currently used polyimide layers. This relaxes the ink compatibility and front face wetting issues. The thinner polymer layer may be cured at a sufficiently high temperature to increase its corrosion resistance.

Figure 5A:
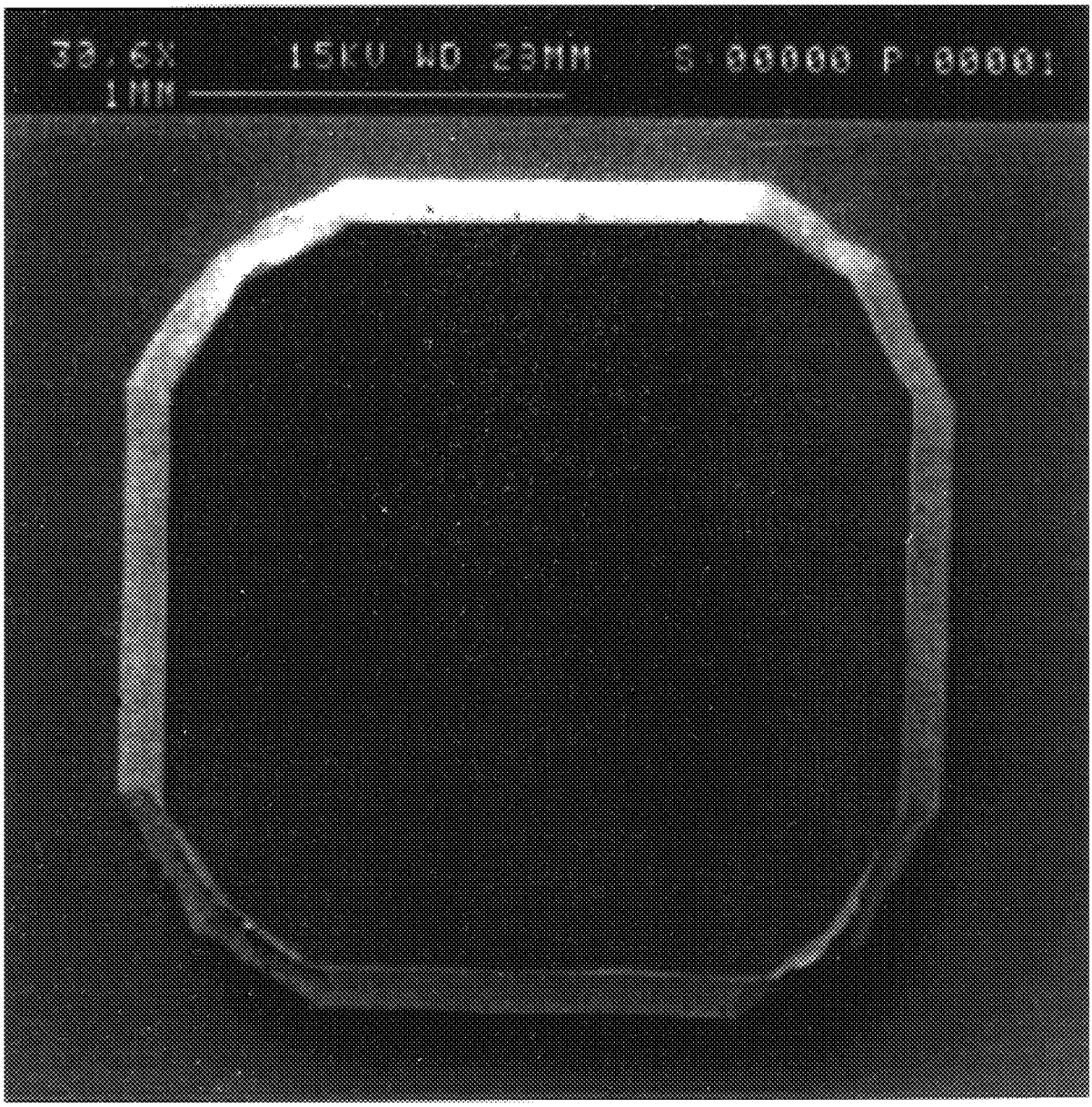
FIG. 5a PRIOR ART
FIG. 5*a* is a scanning electron microscope photograph of a standard potassium hydroxide (KOH) etch of a silicon mesa using a square <110> aligned mask.
Figure 5B:
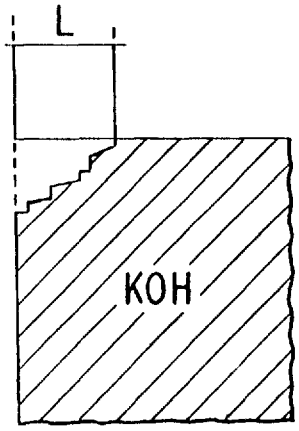
FIG. 5b PRIOR ART
FIG. 5*b* is a depiction of a corner of the mesa of FIG. 5*a*.

The convex corner undercutting behavior of a standard KOH etch is shown in FIG. 5*a*. A square <110> aligned mask is used to etch a 170 micron "high" silicon mesa in 7M KOH at 80° C. The corners of the mesa are heavily undercut, and are formed by a multitude of ill-defined crystal planes and are highly sensitive to angular alignment error. The "undercut ratio," which is defined as lateral undercut length "L" (FIG. 5*a*) divided by the etch depth "D", equals 1.32 for the stated conditions, i.e., a convex corner etches 30% faster laterally than in depth. Moreover, the corners are typically very ragged (FIG. 5*b*) and the undercut ratio is not very reproducible because of the high sensitivity to angular alignment tolerances.

Figure 6B:
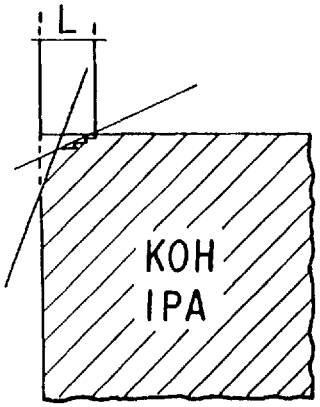
FIG. 6b PRIOR ART
FIG. 6*b* is a depiction of a corner of the mesa of FIG. 6*a*.
Figure 6A:
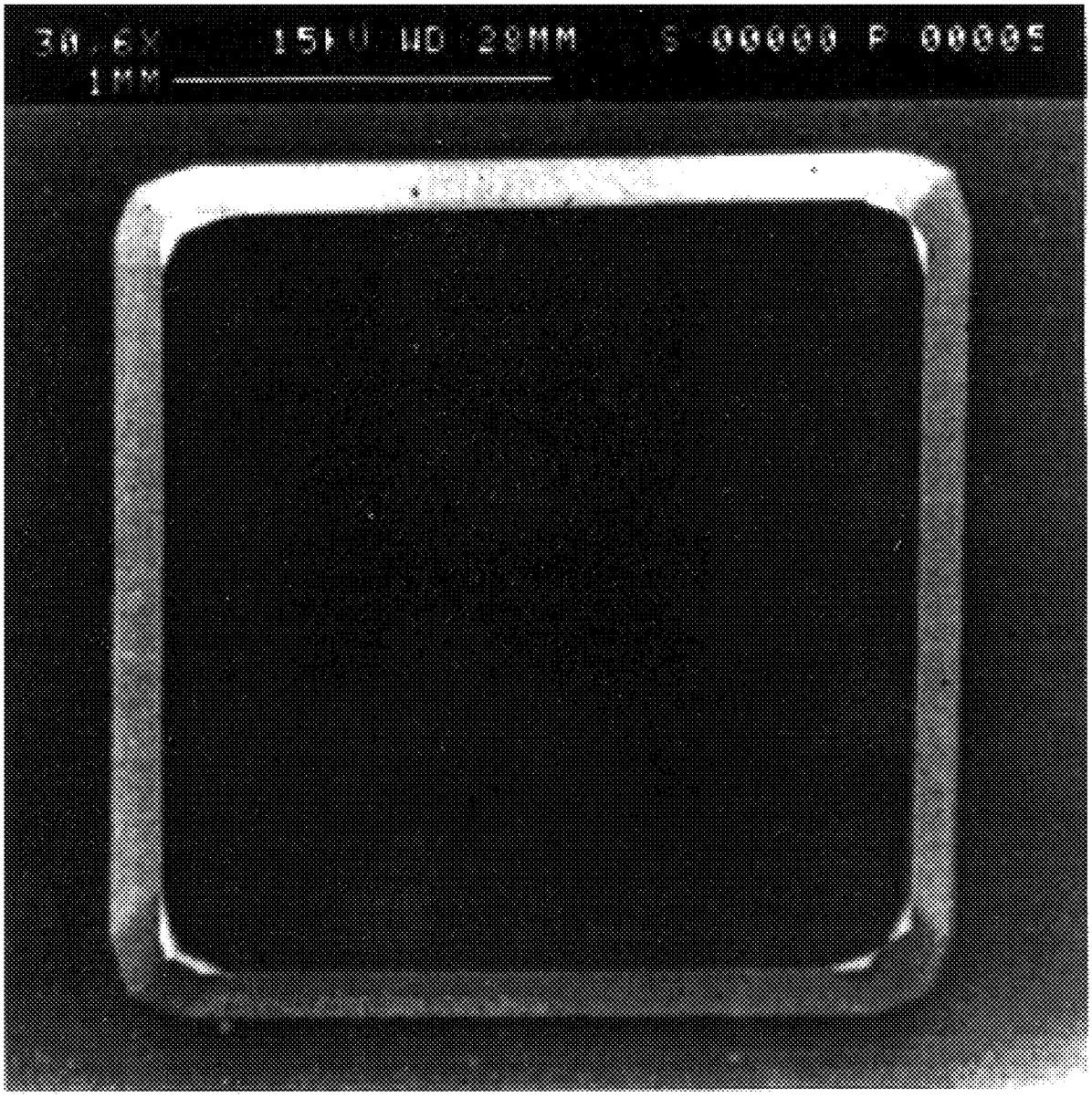
FIG. 6a PRIOR ART
FIG. 6*a* is a scanning electron microscope photograph of a KOH/isopropyl alcohol (IPA) etch of a silicon mesa using a square <110> aligned mask according to the present invention.
Figure 7A:
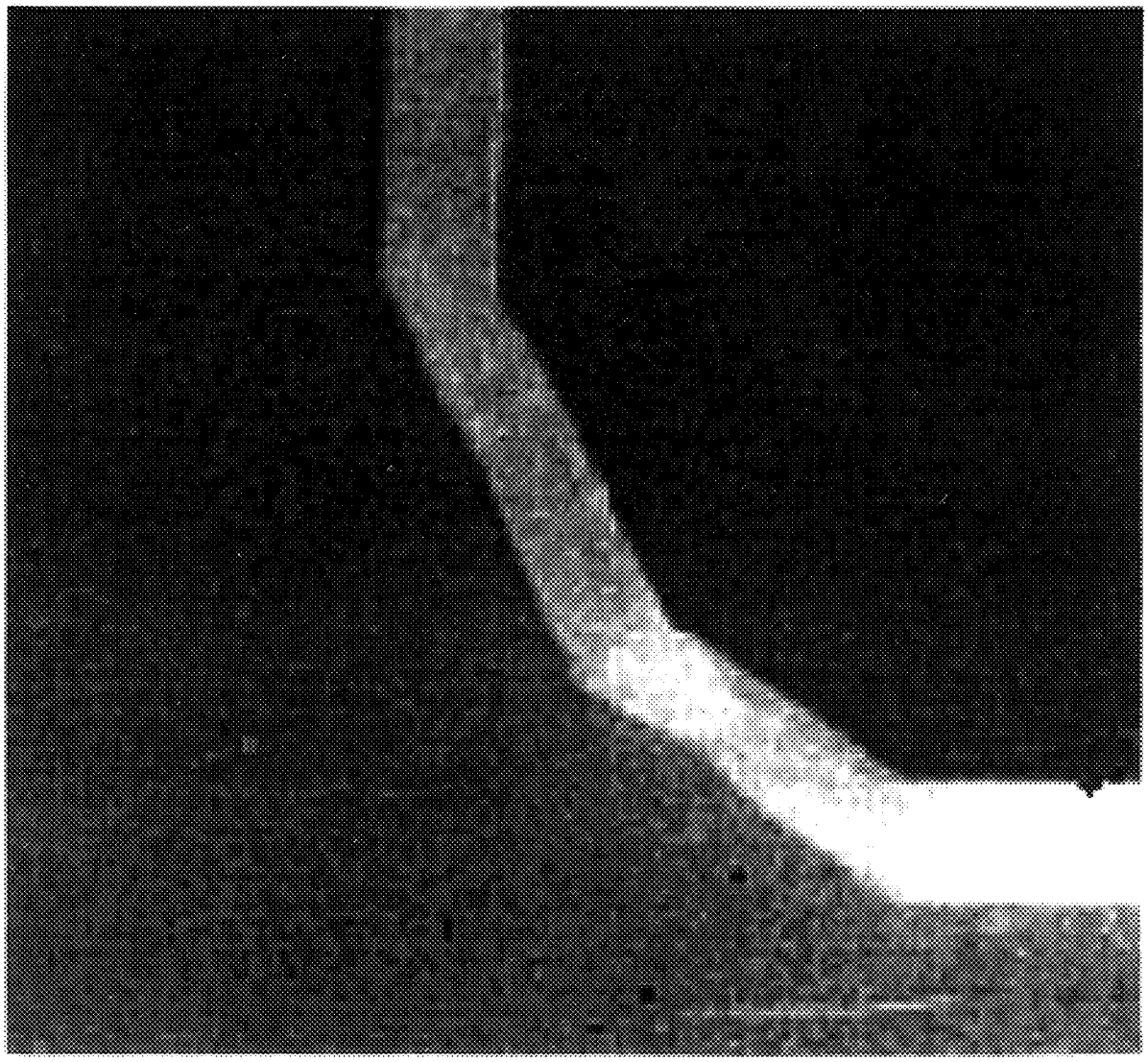
FIG. 7a PRIOR ART
FIGS. 7*a* and 7*b* are scanning electron microscope photographs of corners of the mesas of FIGS. 5*b* and 6*b*, respectively.
Figure 7B:
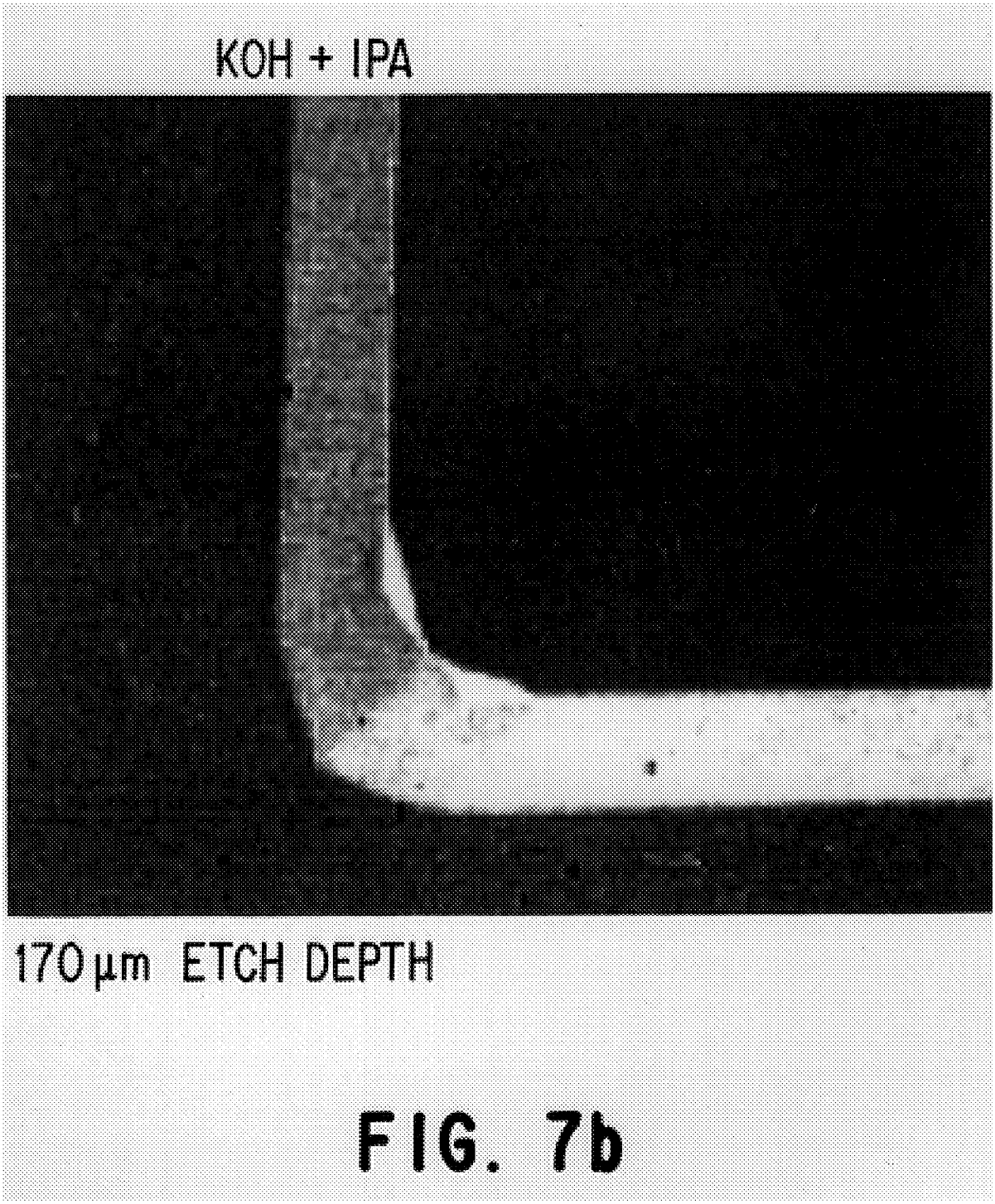

However, the convex corner behavior is very different when an aqueous alkali metal hydroxide etch is saturated with an alcohol compound such as, for example, aqueous KOH saturated with isopropyl alcohol (IPA) (FIG. 6*a*). The corners are no longer ragged, but clean and well defined by two crystal planes close to {221} (FIG. 6*b*). The undercut ratio is reduced from 1.32 to 0.4 (3 or 4 times less lateral undercut) and the undercut reproducibility is strongly improved without any other etch parameter adversely being affected. A close-up view of aqueous KOH and KOH/IPA etched convex corners is shown in FIGS. 7*a* and 7*b*, respectively.

Even though aqueous KOH/IPA etchants are preferred, a number of aqueous alkaline metals combined with one or more alcohols may be utilized in the present invention. Moreover, even though there is only one complex corner geometry described above (e.g., crystal planes close to {221}), other complex geometries may be utilized, depending on various etching parameters (e.g., etchant concentrations, material etched, crystal orientation, etc.).

Figure 8:
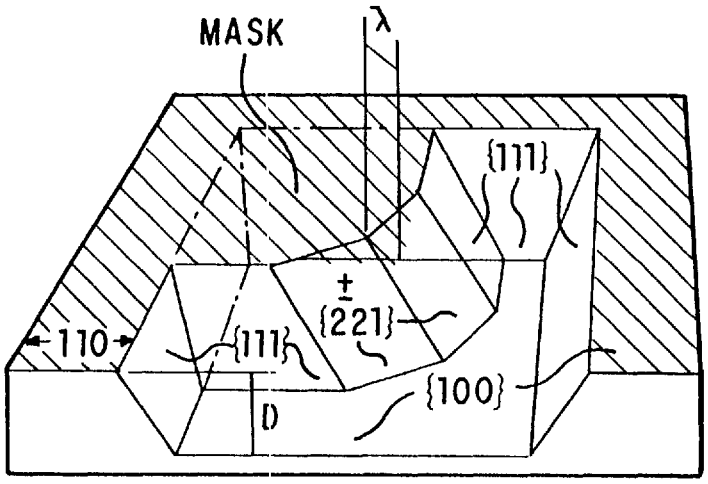
FIG. 8 is an enlarged view of an ink inlet channel corner of the present invention depicting the silicon crystalline planes formed by orientation dependent etching.
Figure 9:
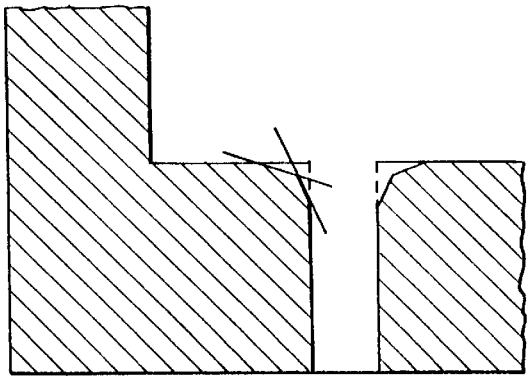
FIG. 9 is an enlarged bottom view of a portion of a channel wafer according to the present invention.
Figure 10:
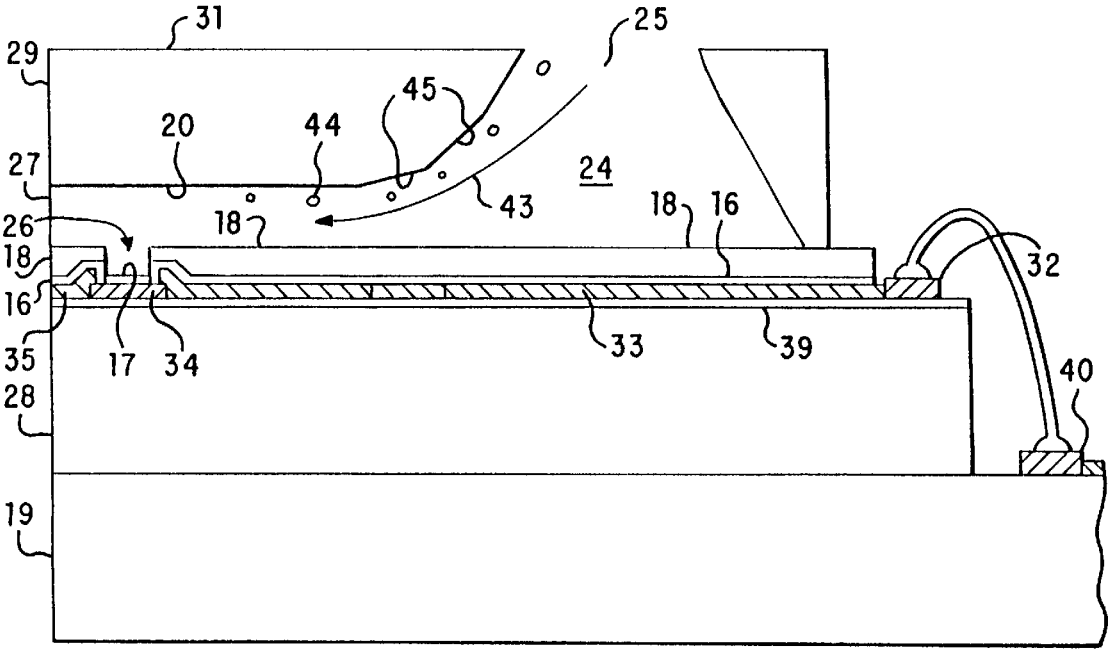
FIG. 10 is an enlarged cross-sectional view of the ink jet printhead of the present invention.

The thermal ink jet structure provided by the superior convex corner properties of the KOH/IPA ODE etch of the present invention are presented in FIGS. 9 and 10, respectively, which show a bottom view of a channel wafer and cross-sectional view of an ink jet printhead with the ink channel directly connected to the ink reservoir. The ink inlet areas are defined by two crystal facets {221} (FIG. 8) both lateral and in cross section. A bypass pit and its related restrictions are no longer required with this structure.

The ink jet printhead of the present invention as shown in FIG. 10 is similar to the ink jet printhead of the prior art shown in FIG. 2. However, the direct connection of channel 20 with ink reservoir 24 allows the ink to flow directly from the reservoir to the channel as shown by arrow 43. Because there is no bypass pit, insulating layer 18 is not etched in the area between the reservoir and the ink channel. The convex corner between the channel and the reservoir 24, defined by two crystal facets {221} and designated 45 in FIG. 10, allows any bubbles 44 ingested through nozzle 27 to flow freely from the channel 20 to the reservoir 24 and out of ink inlet 25. This eliminates any "drop out" problems caused by air bubbles trapped between channel 20 and reservoir 24 that commonly occur in prior art ink jet printheads. Accordingly, the ink jet printhead of the present invention provides reproduceable images with desirable optical density.

An additional advantage of the etchant composition of the present invention is the ability to fabricate a compact die. In a standard alkali metal hydroxide bath, the die size must be increased by several mils to compensate for the excessive etch of the rear channel. The addition of an alcohol compound to the etch bath negates the need for enlarging the die thus allowing for a greater number of dies on a wafer. To achieve a given rear channel length (i.e., the length of channel behind the heater), a non-alcohol containing etchant will require a larger starting channel length and result in a higher etch rate ratio in order to achieve the same etch depth as an alcohol containing etchant. For example, to etch a channel 150 $\mu$m deep would require a rear channel length to be 50 $\mu$m longer than the final desired dimension, whereas with IPA/KOH the length of the channel would be about 50 $\mu$m, thus allowing greater die compaction.

The etch behavior of alkalines such as KOH, TMAH, CsOH or of ethylenediamine pyrocatechol (EDP) and Hydrazine is completely different from the behavior of other basic etches. These etches are reaction rate limited rather than diffusion limited and the keywords describing their effect on single crystalline silicon are anisotropic and agitation insensitive. It is the discovery of the anisotropic etch behavior of the alkaline etchants that initiated silicon micromachining work. Early experiments with EDP and later experiments with tetramethyl ammonium hydroxide proved these etchants to be less performant than alkali metal hydroxide etchants in terms of anisotropy ratio, surface roughness and/or underetching. Moreover, EDP is hazardous. Alkali metal hydroxide etchants are desirable in an environment where LPCVD silicon nitride is available as masking material. The $Si/SiO_2$ selectivity ratio using these etchants under the optimal conditions is not good enough for oxide masking.

The overall etch mechanism involves a two-step formation of soluble silicates, as expressed by:

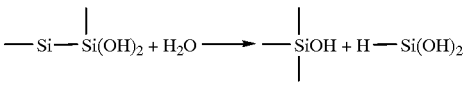

-continued

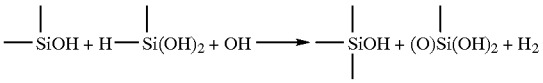

The first step describes attack of the hydrolysed Silattice by water, to form a partial silicate that is still attached to the lattice by a Si—Si bond. The second step describes attack of the partial silicate by hydroxyl groups of the ionized alkaline, to form a soluble silicate. In this reaction, it is silicate formation that is the rate limiting factor, rather than the silicate dissolution. Silicon etching in aqueous alkalines is therefore a reaction rate limited process rather than a diffusion limited process, as the acid etches are. The alkaline etches are therefore inherently much less sensitive to fluid agitation and hence much more predictable and reproducible. Further, water is not a diluent, but plays an active role in the silicate formation reaction. The etch rate therefore increases with the addition of water, up to the point where the second step in the above expression is rate limiting, as the solution becomes depleted from hydroxyl groups. The function of the alkaline group is to provide hydroxyl groups, whereas the complementary ion ($K^+$, $Cs^+$, . . . ) plays no first order role. The aqueous Si-etch behavior of KOH, CsOH and the other alkalines can therefore be expected to be similar in essence. Silicon etching in aqueous alkalines is accompanied by hydrogen gas evolution. These hydrogen bubbles provide a visual endpoint detection, but they can also be trapped or adhere to the surface in high aspect ratio structures and hence adversely influence the etch uniformity.

As the etch of the present invention is essentially agitation independent, the process is characterized by only two control parameters (composition and temperature), which are both well-defined. Good reproducibility and uniformity are therefore inherent to alkaline etch of the present invention. Agitation is only a second order effect, its main function being to maintain a uniform temperature distribution and to avoid adhesion of hydrogen bubbles to the silicon surface being etched.

A typical operating temperature would be about 60–100° C. and preferably about 80° C. Etch times are dependent on etch depth desired and etch bath temperature.

A peculiar and interesting property of the aqueous alkaline etchants of the present invention acting on silicon in its single crystalline form, however, is the strong anisotropy or orientation dependency of the etch rate. The reaction rate of the silicate formation is strongly dependent on crystal orientation. The {111} crystal planes, which are the most densely packed in silicon with its diamond structure, are attacked over two orders of magnitude slower than the crystal planes in other orientations. While this may impose strict layout rules upon the micromechanics designer, the advantage is that it provides a chemical machining technique that etches hundreds of microns deep with virtually no mask underetching, with perfectly defined sidewall planes and with an exceptionally good uniformity and reproducibility.

The addition of an alcohol reduces the anisotropy ratio and the convex corner undercutting in aqueous alkali metal hydroxides. For example, FIGS. 5*a* and 6*a* show a square {100} silicon mesa etched in 7M KOH at 80° C, respectively without any isopropanol and saturated with isopropanol. The etch depth is 170 $\mu$m in both cases. The convex corner undercut however, is 225 $\mu$m for the standard etch and only 70 $\mu$m for the IPA saturated solution. This means that saturating the standard etch with isopropanol reduces the undercut ratio (L/D), defined as the distance of undercut, L, and etch depth D, from 1.32 to 0.41, which is an improvement by over a factor of three. Also, the undercutting front is much better defined by a single type of crystal plane {221} for the entire etch time, as shown in FIG. 8. Addition of isopropanol therefore not only reduces the undercutting ratio, but also the predictability of the undercut. This improves the efficiency of the mask compensation techniques that can be applied to further reduce the undercut.

The use of alcohol compounds as an additive for aqueous alkaline metal hydroxides however, may evoke the formation of pyramidal or cone shaped hillocks randomly distributed over the etched silicon surfaces. The hillocks may be tens of microns in width or height and are therefore usually disastrous for any application. The pyramid formation mechanism is governed by traces of contaminants present in the etch solution. Although very little is known about the mechanism, it has been found that the pyramid formation is a strong function of the resistivity of the deionized water used and, to a lesser extent of the purity of the alkaline metal hydroxide.

The solution to the pyramid formation problem has therefore been the installation of an additional water purification system and venting the reflux etch system with nitrogen to maintain that purity over time. It was found that the use of analysis grade KOH lowers the critical water quality threshold somewhat, but it is not essential if the aforementioned provisions are made. Storage of the alkaline metal hydroxide under dry $N_2$ is desirable.

EXAMPLES

Etchants of the present invention are illustrated in further detail below with reference to KOH/IPA aqueous etchants. However, other alkali metal hydroxides and hydroxyl containing compounds may be utilized. Moreover, single crystal silicon is illustrated as the etched material, but other materials may be utilized such as gallium arsenide, germanium, etc.

Example I

Saturating 7M aqueous KOH at 80° C. with IPA (1) reduces the {100} etch rate somewhat, (2) reduces the {100}/{111} anisotropy ratio and (3) does not affect the uniformity of {100} etch rate and the surface roughness (if appropriate provisions are made to avoid random pyramid formation). For example, the {100} etch rate is reduced by 9%, from 1.08 to 0.99 $\mu$m/min with a predictability of ±0.05 $\mu$m/min. The uniformity of etch rate remains on the order of ±0.5%. The surface roughness is in the order of 100 nm or better. The {100}/{111} anisotropy was again determined with V-groove widening experiments and found to be 289±5, which represents a reduction by 3%.

An LPCVD silicon nitride film with stoichiometric composition was used as masking material for virtually all alkaline metal hydroxide etches of this invention. For example, the etch selectivity $Si/Si_3N_4$ was found to be better than $10^4$ in 7M aqueous KOH at 80° C. As a 120 nm $Si_3N_4$ film shows no visible color change after being exposed to the etchant for 24 h, it can be concluded that the nitride etch rate lies well below 0.1nm/min. It can therefore be considered as essentially nonetching in KOH, with or without IPA, and the required thickness is hence determined by the pinhole density of the film. A film thickness of 120 nm was found to be satisfactory for a stoichiometric LPCVD nitride. A stoichiometric PECVD nitride, on the other hand, has proven to be unsatisfactory due to the lower film density and the abundance of pinholes, even for film thicknesses of 500 nm or more. Thermal annealing of the PECVD films reduces the pinhole density, but can never make them match the LPCVD films.

Wet thermal silicon dioxide can also be used as a mask for 7M KOH at 80° C., but only for more shallow etches, because the $SiO_2$ etch rate is significant. A 500 nm $SiO_2$ film, thermally wet grown at 1000° C. is consumed in 2 h 15 min. ±15 min. The oxide etch rate is therefore 3.7±0.1 nm/min, under the stated conditions. The $Si/SiO_2$ selectivity ratio ~2.40. Etching through a standard 3" 360 $\mu$m thick wafer would require an oxide film of 1.3 $\mu$m or thicker. Due to the extreme pinhole sensitivity of KOH, at least 1.6 $\mu$m is required in practice to keep the defect density at an acceptable level. Thermal oxide is therefore not very suitable for masking deep (250 $\mu$m or more) etches in 7M KOH at 80° C. If no LPCVD nitride is available, thermal oxide can be a solution for 3" wafers, provided the etch temperature is lowered. The $Si/SiO_2$ selectivity ratio increases considerably with decreasing temperature. It was found that reducing the temperature will increase the $Si/SiO_2$ selectivity ratio. However, a 1.2 $\mu$m oxide is still required due to the presence of pinholes. Moreover, the Si etch rate is even more significantly reduced because of the temperature drop, while the surface roughness for a given etch depth increases.

It must therefore be concluded that stoichiometric LPCVD silicon nitride is preferred for masking an aqueous alkaline/alcohol etch. An oxide film is normally used, mainly to serve as an etchstop or buffer layer in the plasma etching process for patterning the nitride films. After anisotropic etching, the nitride can be removed by a plasma etch without affecting the etched wafer if the nitride deposition is preceded by a short thermal oxidation.

Example II

A preferred etch recipe that provides etch rate, uniformity of etch rate, and surface roughness for {100} silicon while still minimizing convex corner undercutting is:

7M KOH in $H_2O$±300 ml/l (oversaturated)

2-propanol at 80±1° C.

The main etch specifications are:

| | |
|---|---|
| {100} etch rate: | 0.99 ± 0.05 $\mu$m |
| Uniformity of {100} etch rate: | ±0.25% |
| {111} etch rate: | 3.4 ± 0.2 nm/min |
| {100}/{111} anisotropy ratio: | 289 ± 5 |
| {111} Slope: | 54.7 ± 0.5° |
| Convex undercut rate: | 0.4 ± 1 $\mu$m/min |
| Undercutting ratio: | 0.41 ± 0.05 |
| Sub-threshold undercut ratio: | tendency for defect growth |
| Surface roughness (Ra): for 350 $\mu$m etch depth & 10 nm initial roughness | 100 nm (if pyramid growth is avoided) |
| LPCVD $Si_3N_4$ etch rate: | <0.1 nm/min |
| {100}/LPCVD $Si_3N_4$ selectivity ratio: | $>10^4$ |

The stated etch specifications are provided under the following conditions:

- The etchant is stirred with a magnetic stirrer to avoid temperature gradients and surface adhesion of hydrogen bubbles and/or contaminant molecules.
- A reflux condenser is used to maintain the initial etchant concentration over time.
- The temperature is controlled to within ±1° C. Preferably, large volumes of etchant and heating water are used.
- The wafers are positioned in such a way as to avoid hydrogen bubble trapping.

What is claimed is:

1. An ink jet channel wafer for an ink jet printer comprising a surface comprising:

a) a plurality of anisotropically etched ink channels, and b) an anisotropically etched ink reservoir;

said ink reservoir being directly connected to said ink channels by convex corners, said convex corners being defined by at least one crystal {221} plane and wherein walls of said ink channels are on a crystal {111} plane.

2. An ink jet channel wafer according to claim 1, wherein said ink reservoir is directly connected to an ink inlet in a second backside surface of said ink jet channel wafer.

3. An ink jet channel wafer according to claim 1, where in said wafer comprises silicone.

4. An ink jet channel wafer according to claim 1, wherein said ink jet channel wafer comprises a heater pit anisotropically etched in said first surface.

5. An ink jet printhead for an ink jet printer comprising:

a) an upper ink jet channel wafer comprising on a surface a plurality of anisotropically etched ink channels directly connected to an anisotropically etched ink reservoir by convex corners, said convex corners being defined by at least one crystal {221} plane, and wherein walls of said ink channels are on a crystal { 111} plane, and b) a lower heater wafer comprising heater elements wherein said upper ink jet channel wafer is on said lower heater wafer.

6. A ink jet printhead according to claim 5, wherein said upper ink jet channel wafer comprises an anisotropically etched heater pit formed in said first surface.

7. An ink jet channel wafer according to claim 5, wherein said wafer comprises silicon.

8. A method of ink jet printing comprising:

a) providing a substrate; and b) printing on said substrate using the ink jet printhead of claim 5.

9. An ink jet channel wafer according to claim 1, wherein said convex corners are defined by two crystal {221} planes.

10. An ink jet channel wafer according to claim 1, wherein said convex corners are defined by at least two crystal {221} planes.

11. An ink jet printhead according to claim 5, wherein said convex corners are defined by two crystal {221} planes.

12. An ink jet printhead according to claim 5, wherein said convex corners are defined by at least two crystal {221} planes.

* * * * *